US009874229B2

(12) United States Patent
Chen et al.

(10) Patent No.: US 9,874,229 B2
(45) Date of Patent: Jan. 23, 2018

(54) MULTI-LEVEL VIBRATION DAMPENING MECHANISM

(71) Applicant: Quanta Computer Inc., Taoyuan (TW)

(72) Inventors: Chao-Jung Chen, Taoyuan (TW); Ming-Sheng Chang, Taoyuan (TW); Chi-Fu Chen, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 302 days.

(21) Appl. No.: 14/723,152

(22) Filed: May 27, 2015

(65) Prior Publication Data

US 2016/0348696 A1 Dec. 1, 2016

(51) Int. Cl.

| | |
|---|---|
| ***F04D 29/66*** | (2006.01) |
| ***F04D 29/60*** | (2006.01) |
| ***F04D 25/16*** | (2006.01) |

(52) U.S. Cl.

CPC ..... *F04D 29/601* (2013.01); *F04D 25/166* (2013.01); *F04D 29/668* (2013.01); *F05D 2260/96* (2013.01)

(58) Field of Classification Search

CPC .... F04D 29/601; F04D 29/522; F04D 29/668; F05D 2260/96; G06F 1/203

See application file for complete search history.

(56) References Cited

U.S. PATENT DOCUMENTS

| | | | | |
|---|---|---|---|---|
| 6,435,889 | B1 | 8/2002 | Vinson et al. | |
| 7,641,441 | B2 | 1/2010 | Pchuang | |
| 7,907,404 | B2 * | 3/2011 | Wu | G06F 1/20 248/635 |
| 8,388,305 | B2 * | 3/2013 | Li | F04D 25/166 415/119 |
| 9,404,510 | B2 * | 8/2016 | Zhu | F04D 19/007 |
| 2008/0259562 | A1 * | 10/2008 | Chen | H05K 7/20727 361/690 |

FOREIGN PATENT DOCUMENTS

| | | |
|---|---|---|
| CN | 204131896 | 1/2015 |
| TW | M311071 | 5/2007 |
| TW | I337226 | 2/2011 |

OTHER PUBLICATIONS

Office Action dated Dec. 24, 2015 in Taiwanese Application No. 104121359.

English language summary of Office Action dated Dec. 24, 2015 in Taiwanese Application No. 104121359.

English language translation of Abstract of TW I337226.

English language translation of Abstract of TW M311071.

English language translation of Abstract of CN 204131896.

* cited by examiner

*Primary Examiner* — Ninh H Nguyen

(74) *Attorney, Agent, or Firm* — Nixon Peabody LLP; Eduardo J. Quinones; Zhou Lu

(57) ABSTRACT

In some implementations, cooling fans can be mounted in a server chassis using a multi-level vibration dampening mechanism to reduce the transmission of fan vibrations to the server chassis. For example, a plurality of cooling fans can be housed within a plurality of fan cages. The plurality of fan cages can be mounted to a cooling fan tray. The cooling fan tray can be mounted to the chassis. For example, the mountings used to attach the fan cages to the tray and the tray to the chassis can include resilient vibration dampers. Thus, the vibrations generated by the cooling fans can be more effectively reduced and operation of vibration sensitive server components can be improved.

17 Claims, 2 Drawing Sheets

MULTI-LEVEL VIBRATION DAMPENING MECHANISM

TECHNICAL FIELD

The disclosure generally relates to reducing vibration generated by components within a computing system.

BACKGROUND

Conventionally, cooling fans are used to cool computing components within a server. For example, a plurality of cooling fans can be housed within a server chassis and arranged to push or pull air through the chassis to cool the computing components within. However, due to the high frequency rotation of the blades of the cooling fans, the cooling fans typically produce a large amount vibration. The vibration can interfere with the operation of various computing components, such as hard disk drives, and can reduce the operational availability and service life of the components.

SUMMARY

In some implementations, cooling fans can be mounted in a server chassis using a multi-level vibration dampening mechanism to reduce the transmission of fan vibrations to the server chassis. For example, a plurality of cooling fans can be housed within a plurality of fan cages. The plurality of fan cages can be mounted to a cooling fan tray using vibration dampening mounts. The cooling fan tray can be mounted to the chassis using vibration dampening mounts. For example, the mounting mechanisms used for mounting the fan cages and/or the tray can include resilient (e.g., rubber) vibration dampers. Thus, the vibrations generated by the cooling fans can be reduced and operation of vibration sensitive server components can be improved.

Particular implementations provide at least the following advantages: vibration caused by operation of a cooling fan is reduced while functionality of the cooling fan remains intact; and the effect of fan vibration on vibration sensitive computing components can be reduced.

Details of one or more implementations are set forth in the accompanying drawings and the description below. Other features, aspects, and potential advantages will be apparent from the description and drawings, and from the claims.

DESCRIPTION OF DRAWINGS

Like reference symbols in the various drawings indicate like elements.

DETAILED DESCRIPTION

Figure 1A:
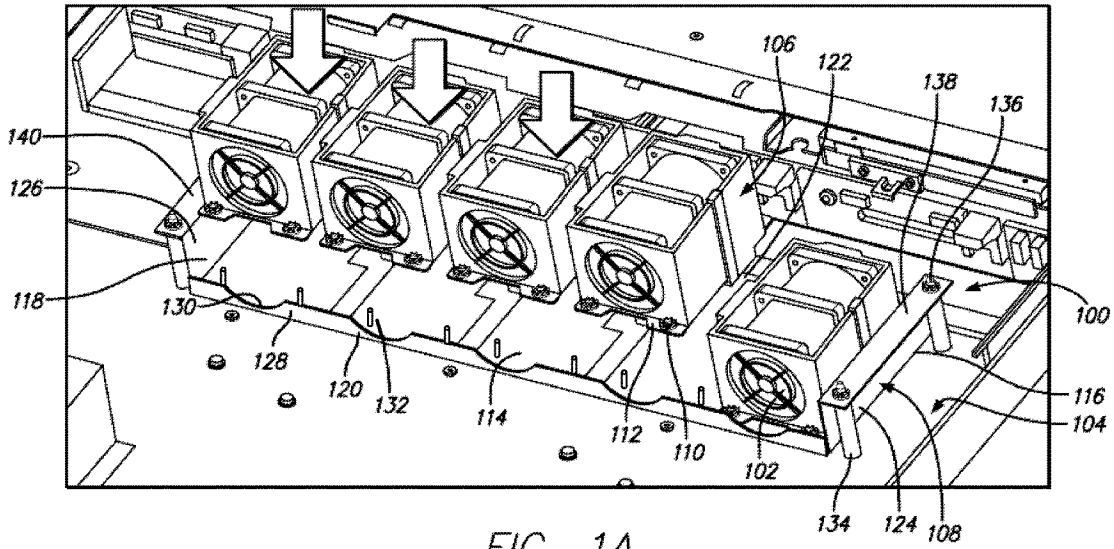
FIG. 1A is an isometric view of an apparatus comprising a plurality of fan cages mounted to a fan tray.

FIG. 1A illustrates an example apparatus 100 including a multi-level vibration dampening mechanism for reducing noise and vibration caused by cooling fans 102 in server blade 104. For example, the multi-level vibration dampening mechanism can include vibration dampeners located at a first levels between cooling fans 102 and fan tray 108. The multi-level vibration dampening mechanism can include vibration dampeners at a second level between fan tray 108 and the chassis of server blade 104.

In some implementations, cooling fans 102 can be housed within fan cages 106, which are mounted to fan tray 108. For example, the mounting between fan cages 106 and fan tray 108 can include a resilient dampening means, such as rubber, plastic, or springs, to couple fan cages 106 to fan tray 108. In some implementations, fan cages 106 can comprise resilient mounts 110 for mounting fan cages 106 to fan tray 108 to provide a first level of vibration reduction. For example, resilient mounts 110 can be any type of resilient vibration isolator (e.g., silicone, rubber polymers, and other elastomeric materials) known in the art for use in combination with attachment means such as nails and screws for soft mounting fan cages 106 to fan tray 108. Resilient mounts 110 can be located on mounting portion 112 of fan cage 106, for example. In some implementations, fan cages 106 can each include a plurality of resilient mounts 110. Each resilient mount 110 can be adapted to correspond to a specific mounting portion 112. For example, fan cage 106 can comprise four resilient mounts 110 and four mounting portions 112. Each resilient mount 110 can correspond to a single mounting portion 112. In some implementations, fan cages 106 can be mounted to fan tray 108 using resilient fasteners (e.g., rubber screws, rubber rivets, etc.).

In some implementations, fan cages 106 can each be adapted to house at least one cooling fan 102. In some implementations, cooling fans 102 can each be programmed to spin clockwise or counterclockwise. For example, cooling fans 102 can be arranged in a row such that cooling fans 102 are alternating clockwise and counterclockwise (e.g., a first fan can spin clockwise, the next adjacent fan can spin counterclockwise, etc.).

Fan tray 108 can comprise base 114, first side 116, second side 118, third side 120, and fourth side 122. In some implementations, first side 116 can be opposed to second side 118. In other implementations, third side 120 can be opposed to fourth side 122. For example, base 114 can be flat, planar, and substantially rectangular in shape. In some implementations, first wall 124 can extend upwards from base 114 on first side 116, and second wall 126 can extend upwards from base 114 on second side 118. For example, first wall 124 can be perpendicular to base 114, and second wall 126 can be perpendicular to base 114. First wall 124 and second wall 126 can be substantially similar in height and shape such that fan cages 106 can be securely mounted in a row there between.

In some implementations, first abutment 128 can extend upwards from base 114 on third side 120. For example, first abutment 128 can be perpendicular to base 114. In some implementations, first abutment 128 can be shaped such that it can secure fan cages 106 while also allowing airflow generated by cooling fans 102 to pass over first abutment 128. For example, first abutment 128 can comprise contoured dip 130. In some implementations, contoured dip 130 can be lower in height than other parts of abutment 128 to allow airflow generated by cooling fans 102 to pass over first abutment 128. For example, contoured dip 128 can be circular in shape.

In some implementations, second abutment (not shown) can extend upwards from base 114 on fourth side 122. Second abutment can be substantially similar to first abutment 128 in height and shape to allow for airflow generated by cooling fans 102 to pass over.

In some implementations, fan tray 108 can be adapted to mount fan cages 106 to base 114. For example, base 114 can comprise mounting posts 132 such that fan cages 106 can be mounted to base 114. Mounting posts 132 can be sized and shaped to insert into resilient mounts 110 of fan cage 106.

For example, fan cage 106 can be mounted on to mounting posts 132 through rubber mounts 110. In some implementations, a plurality of mounting posts 132 can be used to mount a plurality of fan cages 106 in a row on fan tray 108. For example, each mounting post 132 can be substantially similar in size and shape. Each mounting post 132 can also be a uniform distance apart such that fan cages 106 can be mounted side-by-side in a row on base 114.

In some implementations, securing posts 134 can be used to mount fan tray 108 to server blade 104 to provide a second level of vibration reduction. For example, securing post 134 can be elongate and cylindrical in shape and fixedly mounted to server blade 104. Fan tray 108 can include resilient damper 136 for reducing the amount of vibration transmitted from fan tray 108 to server blade 104. Resilient damper 136 can be made of silicone, rubber polymers, and other elastomeric materials known in the art. For example, resilient damper 136 can be a rubber grommet inserted into a mounting point (e.g., hole) in fan tray 108. In some implementations, fan tray 108 can be mounted to securing post 134 at resilient damper 136. For example, fan tray 108 can include wall 124 and lip 138. Fan tray 108 can include wall 126 and lip 140. Fan tray 108 can be mounted to securing posts 134 through resilient dampers 136 at lip 138 and lip 140. Securing posts 134 can be made of any material known in the art, including, but not limited to, metal, alloys, plastic, wood, rubber, etc.

In some implementations, securing posts 134 can be long enough to support fan tray 108 while allowing fan tray 108 to float a distance above the floor of server blade 104. For example, fan tray 108 can be adapted so that base 114 does not touch server blade 104, such that vibrations caused by cooling fans 102 is minimized.

Figure 1B:
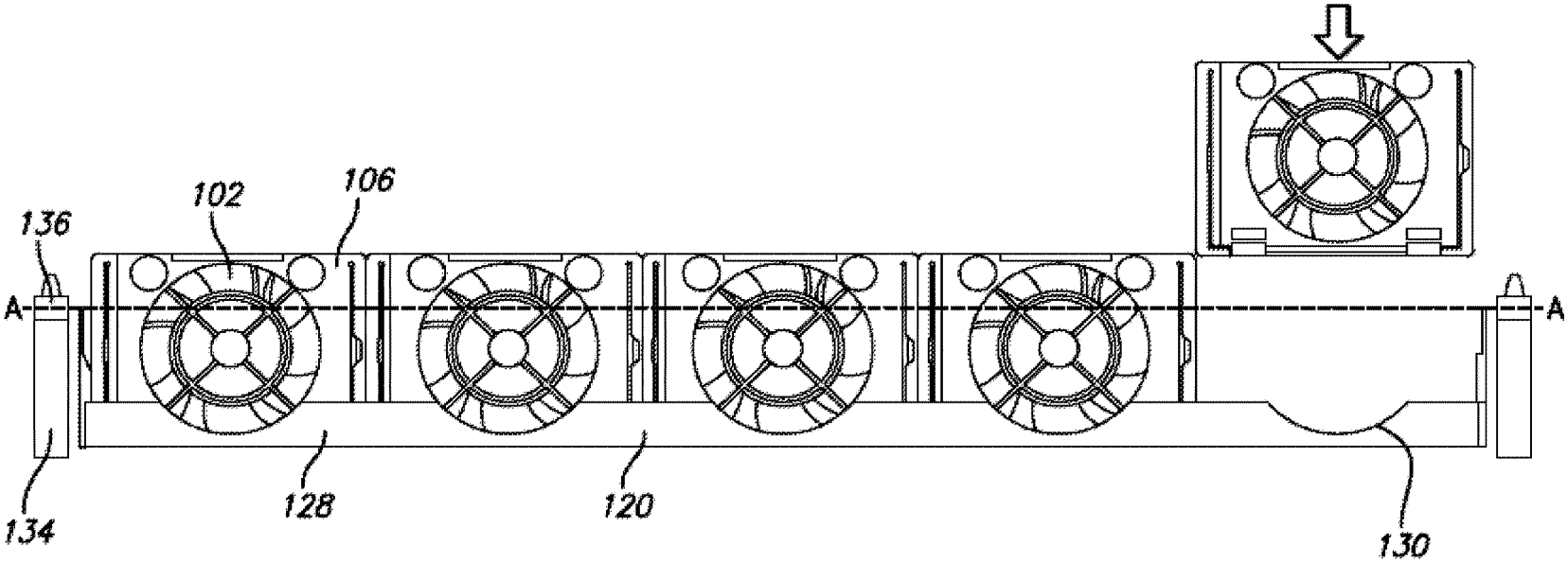
FIG. 1B is a front view of the apparatus of FIG. 1.

FIG. 1B illustrates a front view of apparatus 100. In some implementations, the support location of resilient dampers 136 of fan tray 108 is located above the center of gravity of the fan cages 106 mounted on fan tray 108. For example, dotted line A-A illustrates the mounting location of resilient dampers 136 to securing posts 134 at a height that is above the center of gravity of each of fan cages 106 mounted on fan tray 108. For example, securing fan cages 106 to fan tray 108 at dampers 136 located above the centers of gravity of fan cages 106 may allow for greater stability when cooling fans 102 are operational.

In some implementations, fan cages 106 can include side dampers (e.g., silicone, rubber polymers, and other elastomeric materials). For example, the side dampers can be located on opposing sides of fan cages 106 such that when fan cages 106 are secured side-by-side in a row on fan tray 108, vibrations transmitted from one fan cage 106 to another adjacent fan cage 106 are minimized. For example, the side dampers can be located between each fan cage 106 when mounted on fan tray 108. In some implementations fan cages 106 can be linked together side-by-side in a row.

For clarity and simplicity, only one fan tray is described. However, multiple fan trays securing multiple fan cages can be supported by the above disclosure. For example, multiple fan trays can be coupled to a chassis to secure multiple fan cages according to the disclosure herein.

In addition, numerous specific details are set forth in order to provide a thorough understanding of the embodiments described herein. However, it will be understood by those of ordinary skill in the art that the embodiments described herein can be practiced without these specific details. In other instances, methods, procedures and members have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening members, and is not necessarily limited to physical connections. The connection can be such that the objects are permanently connected or releasably connected. The term "substantially" is defined to be essentially conforming to the particular dimension, shape or other word that substantially modifies, such that the member need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Although a variety of examples and other information were used to explain aspects within the scope of the appended claims, no limitation of the claims should be implied based on particular features or arrangements in such examples, as one of ordinary skill would be able to use these examples to derive a wide variety of implementations. For example, the fan cages can be secured on top of each other in multiple rows while also being secured to the fan tray according to the disclosure above. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

What is claimed is:

1. An apparatus comprising:

a first fan cage housing a first cooling fan for a computer system, the fan cage including a plurality of resilient mounts;

a fan tray including a plurality of mounting posts and a plurality of resilient dampers, wherein each of the plurality of mounting posts are coupled to a corresponding one of the plurality of resilient mounts in the fan cage, wherein the fan tray is coupled to a plurality of fan cages, each fan cage housing a cooling fan; and a chassis for the computer system having a plurality of securing posts, wherein each of the securing posts is coupled to a corresponding one of the plurality of resilient dampers of the fan tray.

2. The apparatus of claim 1, wherein the fan tray has a base, wherein the chassis has a floor, and wherein the base of the fan tray is separated from the floor of the chassis by a distance such that the base of the fan tray floats above the floor of the chassis.

3. The apparatus of claim 1, wherein the resilient mounts are made of rubber.

4. The apparatus of claim 1, wherein the resilient dampers are made of rubber.

5. The apparatus of claim 1, wherein the fan tray includes a lip that is located above a center of gravity of the first cooling fan.

6. The apparatus of claim 1, wherein the first fan cage is mounted to the fan tray using the resilient mounts.

7. The apparatus of claim 1, wherein the first fan cage is mounted to the chassis using the resilient mounts of the fan cage and the resilient dampers of the fan tray.

8. The apparatus of claim 1, wherein the fan tray is coupled to the chassis at a location that is above a center of gravity of the first cooling fan.

9. The apparatus of claim 1, wherein each of the plurality of fan cages includes a side damper to reduce transmission of vibrations between the plurality of fan cages.

10. An apparatus comprising:

a first fan cage housing a first cooling fan for a computer system, the fan cage including a plurality of resilient mounts;

a fan tray including a plurality of mounting posts and a plurality of resilient dampers, wherein each of the plurality of mounting posts are coupled to a corresponding one of the plurality of resilient mounts in the fan cage, wherein the fan tray is coupled to the chassis at a location that is above a center of gravity of the first cooling fan; and a chassis for the computer system having a plurality of securing posts, wherein each of the securing posts is coupled to a corresponding one of the plurality of resilient dampers of the fan tray.

11. The apparatus of claim 10, wherein the fan tray has a base, wherein the chassis has a floor, and wherein the base of the fan tray is separated from the floor of the chassis by a distance such that the base of the fan tray floats above the floor of the chassis.

12. The apparatus of claim 10, wherein the resilient mounts are made of rubber.

13. The apparatus of claim 10, wherein the resilient dampers are made of rubber.

14. The apparatus of claim 10, wherein the fan tray includes a lip that is located above a center of gravity of the first cooling fan.

15. The apparatus of claim 10, wherein the first fan cage is mounted to the fan tray using the resilient mounts.

16. The apparatus of claim 10, wherein the first fan cage is mounted to the chassis using the resilient mounts of the fan cage and the resilient dampers of the fan tray.

17. The apparatus of claim 10, wherein the fan tray is coupled to a plurality of fan cages, each fan cage housing a cooling fan.

* * * * *